US011045389B2

(12) United States Patent
Brandenburger et al.

(10) Patent No.: US 11,045,389 B2
(45) Date of Patent: Jun. 29, 2021

(54) COVER FOR A CONTAINER FOR RECEIVING AN ENTERAL NUTRITION SOLUTION

(71) Applicant: Fresenius Kabi Deutschland GmbH, Bad Homburg (DE)

(72) Inventors: Torsten Brandenburger, Reichelsheim (DE); Stefan Schwerer, Florstadt (DE); Christian Ebert, Frankfurt (DE)

(73) Assignee: Fresenius Kabi Deutschland GmbH, Bad Homburg (DE)

( * ) Notice: Subject to any disclaimer, the term of this patent is extended or adjusted under 35 U.S.C. 154(b) by 326 days.

(21) Appl. No.: 15/766,107

(22) PCT Filed: Oct. 7, 2016

(86) PCT No.: PCT/EP2016/074029
§ 371 (c)(1),
(2) Date: Apr. 5, 2018

(87) PCT Pub. No.: WO2017/060445
PCT Pub. Date: Apr. 13, 2017

(65) Prior Publication Data

US 2018/0296438 A1 Oct. 18, 2018

(30) Foreign Application Priority Data

Oct. 9, 2015 (EP) ..... 15189117

(51) Int. Cl.
*A61J 1/14* (2006.01)
*A61J 9/00* (2006.01)
*A61J 15/00* (2006.01)

(52) U.S. Cl.
CPC ..... *A61J 1/1406* (2013.01); *A61J 1/1412* (2013.01); *A61J 1/1418* (2015.05); *A61J 1/1462* (2013.01);
(Continued)

(58) Field of Classification Search
CPC combination set(s) only.
See application file for complete search history.

(56) References Cited

U.S. PATENT DOCUMENTS 1,528,283 A * 3/1925 Whitesides ..... B67B 7/26 222/90
2,668,533 A * 2/1954 Evans ..... A61M 5/162 604/405
(Continued)

FOREIGN PATENT DOCUMENTS

CN 101678930 B 12/2012
CN 104780893 B 1/2018
(Continued)

*Primary Examiner* — Guy K Townsend
(74) *Attorney, Agent, or Firm* — Occhiuti & Rohlicek LLP

(57) ABSTRACT

Disclosed is a cover for a container for receiving enteral nutrition solutions, having a thread which can be brought into engagement with a mating thread of a container for receiving an enteral nutrition solution in order to cover an opening in the container for receiving the enteral nutrition solution, and having a connection piece for the connection of a hose line. An opening device having a first part connected to the cover in a form-fitting and/or force-fitting manner and having a second part which is permanently connected to the first part is arranged on an inner side of the cover. In a starting state of the opening device, the second part of the opening device is fixed to the first part of the opening device by a fixing element and, in an opening state of the device, is movable relative to the first part of the opening device.

24 Claims, 4 Drawing Sheets

(52) U.S. Cl.
CPC ..... *A61J 1/1475* (2013.01); *A61J 9/00* (2013.01); *A61J 15/00* (2013.01)

(56) References Cited

U.S. PATENT DOCUMENTS 2,969,063 A * 1/1961 Broman ..... A61M 5/1412 604/246
3,001,525 A * 9/1961 Hendricks ..... A61M 5/1411 604/416
3,542,240 A * 11/1970 Solowey ..... A61M 5/162 222/83
3,599,836 A * 8/1971 Hegi ..... B67B 7/26 222/90
3,973,698 A * 8/1976 Kato ..... B67B 7/26 222/91
4,022,258 A * 5/1977 Steidley ..... A61M 5/162 141/330
4,189,072 A * 2/1980 Conn ..... B65D 51/24 220/705
4,296,786 A * 10/1981 Brignola ..... A61J 1/2089 141/309
4,475,670 A * 10/1984 Rutter ..... B65D 77/067 222/105
4,544,336 A * 10/1985 Faeser ..... A61M 5/142 417/412
4,560,382 A * 12/1985 Isono ..... A61J 1/10 604/408
4,801,007 A * 1/1989 Rule ..... A61J 11/04 206/217
4,826,500 A * 5/1989 Rautsola ..... A61J 1/1406 222/91
4,881,662 A * 11/1989 Tallman ..... B67B 7/26 222/81
4,888,008 A * 12/1989 D'Alo ..... A61M 5/162 604/411
4,895,275 A * 1/1990 Quinn ..... B67B 7/26 222/155
4,921,138 A * 5/1990 Quinn ..... A61M 5/1417 222/155
4,997,429 A * 3/1991 Dickerhoff ..... A61M 5/162 604/405
5,052,614 A * 10/1991 Xuan ..... B65D 5/72 229/103.1
5,125,522 A * 6/1992 Pezzoli ..... A61J 1/1475 215/250
5,125,886 A * 6/1992 Dirksing ..... B29C 65/02 264/248
5,228,592 A * 7/1993 Pellerano ..... B65D 51/224 222/83
5,303,751 A * 4/1994 Slater ..... B29C 66/242 141/329
5,531,681 A * 7/1996 Walton ..... A61M 5/007 604/8
5,851,608 A * 12/1998 Yamada ..... B32B 27/10 428/34.2
5,960,992 A * 10/1999 Bernstein ..... B65D 5/748 222/541.2
5,971,207 A * 10/1999 McDonough ..... B05B 7/1445 222/1
5,993,422 A * 11/1999 Schafer ..... A61M 5/1454 604/154
6,139,534 A * 10/2000 Niedospial, Jr. ..... A61J 1/2096 604/403
6,223,924 B1 * 5/2001 Ek ..... B65D 5/748 215/230
6,336,912 B1 * 1/2002 Bourguignon ..... A61J 1/2089 604/65
6,378,730 B1 * 4/2002 Reddy ..... B67B 7/26 222/541.9
6,382,462 B1 * 5/2002 Ostergaard-Nielsen ..... B65D 5/749 222/1
6,422,412 B1 * 7/2002 Sagawa ..... B65D 5/748 220/277
6,485,479 B1 * 11/2002 Knierbein ..... A61J 1/10 604/411
6,551,639 B1 * 4/2003 Nye ..... A61J 9/001 215/11.1
6,621,700 B1 * 9/2003 Roman ..... H05K 7/20918 165/80.3
6,651,845 B1 * 11/2003 Schroeder ..... B67B 7/28 215/11.3
6,742,678 B1 * 6/2004 Krystopik, Jr. ..... B65D 47/122 215/309
6,932,239 B2 * 8/2005 McKitrick ..... A62B 18/086 215/388
7,232,044 B1 * 6/2007 Salmela ..... B67B 7/26 222/83
7,232,426 B2 * 6/2007 Itrich ..... A61J 15/0015 604/175
7,516,765 B2 * 4/2009 Hogan ..... A61J 1/1475 141/288
8,100,879 B2 * 1/2012 Blank ..... A61M 5/162 604/411
2003/0226855 A1 * 12/2003 Allanson ..... B67B 7/26 222/83
2004/0104246 A1 * 6/2004 Kawaguchi ..... A61J 15/00 222/83
2004/0153047 A1 * 8/2004 Blank ..... B65D 5/746 604/408
2004/0193115 A1 * 9/2004 Itrich ..... A61J 15/0026 604/175
2006/0137763 A1 * 6/2006 Hogan ..... A61M 5/162 141/329
2008/0128418 A1 * 6/2008 Ahn ..... B65D 5/748 220/303
2018/0296438 A1 * 10/2018 Brandenburger ..... A61J 1/1406 222/83

FOREIGN PATENT DOCUMENTS

DE 102007024539 A1 11/2008
EP 1 658 871 5/2006
EP 2919741 B1 5/2017
WO WO2006/057536 6/2006
WO WO2014/078404 5/2014

* cited by examiner

COVER FOR A CONTAINER FOR RECEIVING AN ENTERAL NUTRITION SOLUTION

CROSS REFERENCE TO RELATED APPLICATIONS

This application is the national phase under 35 USC 371 of international application no. PCT/EP2016/074029, filed Oct. 7, 2016, which claims the benefit of the priority date of European application no. 15189117.3, filed Oct. 9, 2015. The contents of the aforementioned applications are incorporated herein by reference in their entireties.

The present invention relates to a cover for a container for receiving an enteral nutrition solution according to the preamble of claim 1, to an opening device for such a cover according to the preamble of claim 14 and to a combination of such a cover with a container for receiving an enteral nutrition solution according to the preamble of claim 15.

In the case of containers for receiving an enteral nutrition solution which are frequently designed as bottles or bags, it is regularly desired to be able to securely store them, on the one hand, and to be able to simply use them for dispensing an enteral nutrition solution contained in the container, on the other hand.

In this regard, such bottles are routinely closed with a covering, in particular a foil, such as, for example, an aluminum foil. Before an enteral nutrition solution held available in the container can be accessed, this foil must be at least partially removed from the bottle opening or at least partially opened. This frequently occurs by generating an opening in the foil.

In EP 1 658 871 A1, the opening is generated by screwing on a screw cap. For this purpose, a cutting device is arranged on the inner side of the screw cap. The cutting device is connected to the air inlet of the cap by means of a snap or friction connection. When screwing on the cap, the cutting device sufficiently cuts open the foil.

An opening can also be generated, for example, by pricking with a spike of a hose line which is part of a transfer system or of an enteral feeding tube. Here, parts of the foil can enter the spike or the hose line and thus lead to blockages of the spike or of the hose line. WO 2014/078404 A1 proposes a screw cap for use in enteral nutrition which is provided on the cap base with an inserted device having a point for piercing open and tearing open the covering.

When a covering is opened by being torn open, for example by means of a spike or by means of the aforementioned inserted device, there can result an unclean opening which can negatively influence the outflow behavior of an enteral nutrition solution from the container.

The object on which the present invention is based is to provide a simplified possibility for opening a container provided with a covering and thus to positively influence the runout behavior of a liquid from the container. In particular, it is intended for a cover to be provided which allows easier and reliable opening of a closed container for receiving an enteral nutrition solution.

This object is achieved by a cover for a container for receiving an enteral nutrition solution having the features of claim 1.

Such a cover has a connecting device, preferably a thread, which can be connected to, preferably brought into engagement with, a connection partner, preferably a mating thread, on a container for receiving an enteral nutrition solution. As a result, an opening in the container can be covered. Furthermore, the cover has a connection piece for the connection of a hose line. This connection piece can be designed, for example, as a conventional port for the introduction of a spike.

According to the invention, in the case of the claimed cover, an opening device is provided on the inner side of the cover. This opening device consists of two parts or comprises two parts. A first part is connected to the cover, preferably in a form-fitting and/or force-fitting manner. The first part can be clipped or latched into the cover, for example. The first part is connected, preferably permanently, to a second part of the opening device. According to the invention, the second part of the opening device comprises a blade. The opening device can, then, be present either in a starting state or in an opening state. In the starting state, the second part of the opening device can be fixed to the first part of the opening device by at least one fixing element. In the starting state, the second part of the opening device is preferably fixed to the first part of the opening device by at least one fixing element. As a result, the second part of the opening device cannot or not substantially move away from the first part of the opening device. Rather, both parts can be retained on one another by the fixing element. Both parts are preferably retained on one another by the fixing element. In the opening state of the opening device, the fixing element no longer prevents a movement or a substantial movement of the second part in relation to the first part of the opening device. Rather, in the opening state of the opening device, the second part of the opening device can move relative to the first part of the opening device. The second part can be permanently movable in the opening state. In the opening state, the second part can also be movable in such a way that it is movable once only from the starting state into the opening state and, where appropriate, is then arrested, for example in a latched-in manner. The second part is or remains preferably permanently connected to the first part.

Whereas the permanent connection between the first part of the opening device and the second part of the opening device allows no or no substantial relative movement of the two parts to one another in the starting state of the opening device, this can thus be possible in the opening state of the opening device. This opening device makes it possible to open a covering which covers the opening in the container as standard. This means that if a spike or another object is introduced through the connection piece into the cover, the spike itself does not ensure an opening of the cover of the container. Rather, the spike transfers the opening device from the starting state into the opening state, with the result that the second part of the opening device then ensures an opening of the covering of the container. The opening or the hole in the covering of the container is produced by the blade of the second part, here by means of cutting. Through cutting, the blade makes possible a better defined opening of the covering by comparison with an opening which is substantially obtained by tearing open.

This covering can in particular be a foil, such as, for example, an aluminum foil. Composite materials for the covering are equally possible. Such coverings are known per se. The present cover is suitable for all containers which are closed with such coverings. If the covering has been opened by the opening device, the cover continues to ensure a covering of the opening in the container. A liquid, such as, for example, an enteral nutrition solution, which is contained in the container, can then only flow out of the container through an opening in the cover. This opening in the cover is preferably provided by the connection piece for the connection of a hose line.

This means that if a hose line which bears a spike or another end piece is guided through the connection piece into the interior of the cover, it initially ensures the transfer of the opening device from the starting state into the opening state and then ensures a discharge of liquid which is contained in the container.

For a user, the cover claimed according to the invention has the major advantage that its handling does not differ from covers known from the prior art. In particular, no further elements, besides the cover and a hose line provided with an end piece, are required in order to use the cover during operation as intended. Nevertheless, by virtue of the opening device present in its interior, the cover claimed according to the invention facilitates the opening of a covering of a container. Moreover, the blade of the opening device ensures a clean opening of the covering, with the result that the container opened by such a cover has a better run-out or pour-out behavior than a container which has been opened in a conventional manner by a spike or another end piece of a hose line being pricked into the covering of the container.

The second part comprises a design in the form of a blade. Here, a cutting edge of the blade or in general of the second part of the opening device is preferably formed on that side of the second part of the opening device which points away from the first part of the opening device. If, in the opening state of the opening device, the second part of the opening device is then moved away (for example swung away) from the first part, the covering of a container that is arranged below the second part of the opening device can be contacted in a particularly simple manner by the cutting knife-like contour or blade-shaped contour and consequently cut open. In one embodiment, the second part of the opening device is designed to be partially or completely in the manner of a cutting knife on an underside of the blade.

In other words, the second part of the opening device serves for cutting open a covering of a container on which the cover is placed. As has already been stated above, the covering of the container can consist, in particular, of an aluminum foil or a composite material which preferably contains aluminum. In this variant, the second part of the opening device then penetrates into the covering by way of its blade like a knife and ensures that the covering is cleanly cut open, with the result that the pour-out or run-out behavior of a liquid from the container is positively influenced by comparison with the solutions known from the prior art.

In a first variant, the fixing element can additionally perform the function of a hinge element. In another variant, the first part of the opening device and the second part of the opening device are connected to one another not only via the fixing element, but also additionally by a hinge element. Here, the hinge element is designed as a component which is configured to be separate from the fixing element. Such an arrangement makes it possible in a particularly simple manner for the second part of the opening device to be or remain connected to the first part of the opening device even if the opening device is no longer situated in its starting state. The hinge element can be configured, for example, as a web-like connecting element which has a certain degree of flexibility and allows a relative connection of the second part of the opening device with respect to the first part of the opening device. For simple manufacturing, the opening device can be produced, for example, as a one-piece injection-molded part.

In a further variant, the hinge element acts on a first end region of the second part of the opening device. At this first end region there is then defined a hinge axis about which the second part of the opening device can be moved or swung with respect to the first part of the opening device.

In a further embodiment of the opening device, the blade comprises a blade tip which is formed in a second end region of the second part of the opening device that is situated opposite to the first end region in the direction of longitudinal extent of the opening device. In this configuration, the covering of the container is first punctured by the blade tip and then cut open by the blade, in particular by the cutting edge of the blade. The blade tip makes it possible for the blade or the cutting edge of the blade to be better positioned on the covering for cutting-open purposes since the blade can engage in the puncture opening. The cutting-open operation is thus facilitated.

In a further variant, in order to provide the blade tip, an underside of the blade and a lateral surface of the blade extend at an acute angle to one another. Here, the lateral surface of the blade is formed in a second end region of the second part of the opening device. The second end region is situated opposite to the first end region in the direction of longitudinal extent of the opening device. This means that if the second part of the opening device is moved around the hinge axis, the first end region covers the greatest distance on a circular arc of the entire second part of the opening device. The acute angle between the underside of the blade and the lateral surface of the blade then ensures that the second part of the opening device can puncture, i.e. initially open, a covering particularly well. This means that the acute angle ensures that the blade has a sufficient sharpness for initially cutting the covering.

In a further embodiment, the second part of the opening device has at least one wing which is arranged laterally on the blade. The at least one wing is preferably arranged on an upper side of the blade. It performs the function of a displacer for the covering in order to increase the opening produced in the covering by means of the blade. The covering is first punctured by the blade tip and then further cut open by the cutting edge of the blade. The wing or wings pushes or push the cut-out covering to the side. As a result, the slot opening produced by the blade is increased toward the side, whereby the throughflow is increased. In a preferred configuration, the second part of the opening device has two wings.

The at least one wing is in particular positioned on the blade so as to be offset away from the blade tip in the direction of the first end region of the second part of the opening device. This particularly assists the interaction between blade and wing in that the covering is first opened by the blade and the slot opening produced is then increased by the wing or wings. In one configuration of the at least one wing, it has an increasing width in the direction of the first end region of the second part of the opening device. As a result, the slot opening produced by the blade can be gradually further widened and thus increased.

In a further variant, the first part of the opening device has a through-opening in a central region of the first part. An attachment piece of a hose line can be guided through this through-opening in order to contact the second part of the opening device. This attachment piece of the hose line can also be referred to as an end piece and be a spike, for example. This variant makes it particularly simple for a hose line which is guided through the connection piece of the cover also to be guided through the first part of the opening device in order that the end piece or the attachment piece of the hose line can contact the second part of the opening device. If a corresponding pressure is then exerted on the second part of the opening device, the opening device is transferred from the starting state into the opening state.

In one embodiment of the cover, a retaining force of the first part of the opening device in the cover is greater than a force which is applied by the fixing element in order to fix the second part of the opening device to the first part of the opening device. Such a configuration ensures that, when transferring the opening device from the starting state into the opening state, an attachment piece of a hose line in fact only brings about a relative movement of the second part of the opening device with respect to the first part of the opening device, but not a release of the opening device from the cover. As already mentioned, the first part of the opening device can, for example, be clipped in a region of the cover that is provided therefor. However, the first part can also be mounted, for example, by means of a snap ring.

In one configuration, the at least one fixing element has a cross section which tapers from the first part in the direction of the second part of the opening device. As a result, it is possible, on the one hand, for a sufficient mechanically stable connection to be provided between the first part and the second part of the opening device. On the other hand, it is thereby also possible for the targeted release of the second part from the first part, in particular when introducing the attachment piece of a hose line, to be assisted. In a preferred configuration, two fixing elements are provided.

In one embodiment of the connection piece, it has a selection device. The connection piece preferably has in certain portions a cruciform geometry, preferably a cruciform opening. Such a geometry makes it possible to ensure that only an attachment piece of a hose line that is adapted to this geometry can be introduced into the connection piece. In this way, the cover can be specifically adapted for use on containers for enteral nutrition solutions since it is then not possible for there to be guided through such a connection piece any cannulas or spikes which are provided for an intravenous application of a medicament or of another solution. Therefore, confusion between different containers for different use purposes can be avoided in this way. The selection device is arranged in particular in an upper region of the connection piece. An upper side of the connection piece is preferably provided by the selection device.

In a further variant, a seal through which an attachment piece of a hose line can be guided is arranged between the connection piece and the opening device. The seal is preferably provided with a slot which is adapted to the geometry of the selection device. This can provide assistance, where appropriate, in ensuring that only an attachment piece of a hose line with a defined geometry can be connected. Such a seal can be used, for example, when the connection piece already has a specifically configured geometry (such as, for example, a cruciform geometry). The seal then assists the function of the connection piece to the effect that substantially only a connection piece of a hose line with a specific geometry can be guided through the connection piece. On the other hand, it is also conceivable to use such a seal precisely when the connection piece has a geometry configured in any desired manner, since then such a seal can ensure that only a connection piece of specific geometry can be guided through it and can transfer the opening device from the starting state into the opening state. It is therefore also possible with such a seal—similarly as with a specific internal geometry of the connection piece—to prevent a situation in which a "false" connection piece can be used for opening the container on which the cover is placed.

In a further variant, the cover has a cap for closing the connection piece. It is thereby possible to effectively counteract any contamination of the connection piece prior to a use of the cover.

The cap for closing the connection piece can, for example, be able to be connected in a reversible manner to the cover. For example, the cap can be connected to the cover by a screw thread. It can then be screwed onto the cover or be unscrewed from the cover. In one variant, there is provision that the cap is provided and designed to be removed from the connection piece by being broken out of the connection piece. This variant has the advantage that it is directly visible to a user which cover was already once in use and which cover is in a state in which it is as new from manufacture. A tamper-evident closure is thereby provided. Contaminations of an enteral feeding solution or of another liquid which is situated in the container which is covered by the cover can be avoided in this way.

In a further variant, the second part of the opening device is arranged substantially parallel to the first part of the opening device in the starting state, whereas it is or can be arranged transversely to the first part of the opening device in the opening state. This means that the relative movement between the first part of the opening device and the second part of the opening device in this variant takes the form of a swinging movement of the second part in relation to the first part. This makes it possible to ensure a particularly controlled and reproducible penetration of the second part of the opening device into a covering which is arranged below the cover. Such a reproducible opening of such a covering is not possible with the solutions known from the prior art since the tear-open behavior of a covering depends crucially on the pressure with which, for example, a spike or another connection part of a hose line is pricked through such a covering. By virtue of the cover claimed according to the invention having the inserted opening device, this dependency is at least reduced or even substantially eliminated. This is because the opening device ensures, substantially independently of the pressure with which a connection piece of a hose acts on it, an always substantially identical opening behavior of an underlying covering.

In a further variant, the cover has at least one vent closed with a filter. The filter is permeable to gases. However, it is impermeable to liquids. It is possible in this way to ventilate the container on which the cover is placed if a covering of the container is already opened and a flow connection is established between the interior of the container and the cover. If then a liquid held available in the container exits through a hose line through the connection piece from the cover and thus from the container, a corresponding volume of gas can flow through the filter into the container. In this way, there occurs pressure equalization between the interior of the container and an atmosphere surrounding the container.

The first part of the opening device and the second part of the opening device preferably consist of a material which, under the forces which prevail when the cover is used as intended, is resistant to deformation. Reliable cutting open of a covering by the second part of the opening device can always be guaranteed in this way. Suitable materials are, for example, plastics, such as, for example, polypropylene, polyethylene or polycarbonate. Here, the wall thickness of the individual parts of the opening device should preferably be greater than a thickness or wall thickness of a covering which is intended to be cut open by the opening device.

The invention also relates to an opening device for a cover according to the above explanations, having a first part which is or can be connected to such a cover in a form-fitting and/or force-fitting and/or integrally bonded manner, and having a second part which is connected, preferably permanently, to the first part and which comprises a blade. Here, in a starting state of the opening device, the second part of the opening device can be fixed to the first part of the opening device by at least one fixing element. In a starting state of the opening device, the second part of the opening device is preferably fixed to the first part of the opening device by at least one fixing element. In an opening state of the opening device, the second part of the opening device is movable relative to the first part of the opening device.

This opening device can be inserted into various covers. Here, the precise configuration of the covers is of little importance. It is relevant only that a receptacle for the opening device is provided.

The variants illustrated in connection with the explained cover can be analogously applied in any desired combination to the separately described opening device.

As already mentioned, the above-described cover is particularly suited to being placed on a container for receiving an enteral nutrition solution. The invention therefore also relates to a combination of a cover corresponding to the above explanations and a container for receiving an enteral nutrition solution. Here, the container has an opening via which an enteral nutrition solution can be fed into the container or out of the container. Arranged around the opening is a connecting device, for example a thread, for receiving the cover. Here, the connecting device, for example the thread, of the cover and the connection partner, for example the thread, of the container are connected to one another in such a way, or are preferably in engagement with one another in such a way, that the cover covers the opening and closes it in a liquid-tight manner. If required, a seal can be provided in the cover or on the container. Here, the opening is in particular provided with a covering which has first to be opened in order that an enteral nutrition solution contained in the container can be transferred from the container into the cover or through the latter into a hose system.

The variants illustrated in connection with the explained cover can be analogously applied in any desired combination to the separately described combination.

A cover according to the above explanations is particularly suited to being used in combination with a container having the features discussed below.

Such a container has an opening via which an enteral nutrition solution, which can also be referred to as an enteral feeding solution, can be fed into the container or out of the container. Furthermore, the container has a bottom which is situated opposite to the opening in a direction of longitudinal extent of the container and which serves to set the container down upright on an underlying surface. If the container thus stands on the bottom, the opening of the container points upwardly away from the bottom. The container further has a suspension element which is arranged on an underside of the bottom and which can be present in two positions. In a first position, it extends substantially along the bottom of the container, for example parallel to a plane defined by the bottom along an outer side of the bottom. In a second position, it projects at an angle to, for example perpendicular to, the plane defined by the bottom.

If the suspension element is situated in its first position, the container can be present in a filling state or in a storage state in which it can be filled or stored. For this purpose, the container can be used in particular while standing on its bottom. With the suspension element in its first position, the container can also be used as a drinks container, for example drinks bottle. If the suspension element is situated in its second position, the container can be suspended, with the opening pointing downward, on a suspension device, such as, for example, a hook or a stand. In this case, this can, in particular in connection with a connected transfer system, also be referred to as the dispensing state or use state of the container.

Furthermore, the container has a hinge device which connects the suspension element at a first end of the suspension element to the underside of the bottom. The hinge device serves to be able to transfer the suspension element from the first position into the second position and from the second position into the first position. That is to say that the suspension element can be swung around from one position into the respective other position by means of the hinge device. It is provided and envisioned here that the change of position of the suspension element can achieve a repeated change of the states of the container. Thus, for example, the container can first be present in its filling state in order subsequently to be transferred into its use state. If the entire enteral nutrition solution present in the container is not used, the container can then be transferred again into its storage state, namely by transferring the suspension element from the second position into the first position. The suspension element can be later transferred from the first position into the second position again and thus the container can be transferred from the stored state into the use state.

The container is distinguished by the fact that a receiving region for the suspension element is formed in the bottom, in which region the suspension element can be releasably fixed in the first position by means of a connecting device. As a result, the suspension element can be securely positioned in the receiving region. The suspension element is intended to be transferred from its first into its second position through a targeted release or opening of the connecting device. For example, an oblique position of the container caused by an unintended angularly projecting suspension element can be substantially avoided. The receiving region for the hanger is preferably configured as a depression in the bottom of the container. The suspension element is preferably not fixed rigidly in the first position but movably within the first position. The second free end of the suspension element is fixed so as to be movable from the top downward within the first position. This particularly facilitates the release of the suspension element from its first position since a manual intervention, for example by means of a fingertip and/or a fingernail, between the hanger and the bottom of the container or the bottom of the receiving region is facilitated.

In a supplementary or alternative configuration, the container is distinguished by the fact that the hinge device extends only over a width of the suspension element which corresponds to the width of a second end of the suspension element which is situated opposite to the first end of the suspension element in a direction of longitudinal extent of the suspension element. Here, "width" is defined as an extent in that direction which extends transversely to the direction of longitudinal extent of the suspension element. In particular, two widths (or two lengths or two other portions) correspond to one another if they differ from one another by up to 50%, in particular with respect to the larger width, in particular by up to 30%. In an alternative or supplementary configuration, the hinge device extends over a width which is less than the width of the second end of the suspension element. In a variant, two widths, lengths or portions which correspond to one another can also be identical or substantially identical to one another.

Such a hinge device which is adapted to the dimensions of the second end of the suspension device and has a width which is reduced by comparison with the prior art means, on the one hand, that less material is required in order to produce the hinge device. Furthermore, the space requirement which the hinge device requires in its first position is significantly reduced. This ensures a greater freedom in the configuration of the bottom of the container. Moreover, there are fewer application points for forces by means of which the hinge device could be torn off or destroyed in some other way. Finally, the force transmission to the hinge device is also improved if a force is applied, for example with a finger, to the suspension device at the second end of the suspension device.

By contrast, in the case of hinge devices which are known from the prior art, the force introduction into those regions which are arranged further away from the maximum width extension of the second end of the suspension device is more unfavorable. Here, it is routinely required to use a greater force in the region of the second end of the suspension device in order to achieve transfer of the suspension device from one position into the other. This can then in turn lead to unwanted destructions of the hinge device.

In contrast to solutions likewise known from the prior art in which no hinge device is provided at all but a suspension device is permanently accessible, the advantage afforded in this embodiment is that the bottom of the container is far less complex and can be produced with a smaller material thickness. This facilitates the manufacturing process of a corresponding container and reduces the manufacturing costs.

Furthermore, an unintended force introduction into the suspension element can be significantly reduced if the suspension element is securely positioned or fixed in the receiving region by the connecting device.

The connecting device is a releasable connecting device. The suspension element can preferably be repeatedly fixed in and again released from its first position by means of the connecting device. Here, the suspension element can be repeatedly transferred from the first position into the second, and vice versa. In a variant, the connecting device is provided by a snap connection. This constitutes a type of connection which is simple to produce.

In order to provide the connecting device, in particular the snap connection, in one embodiment the suspension element has at least one projection in a region of its second end, which projection is provided and designed to engage behind a structure of the receiving region in order to fix the suspension element in the first position. The at least one projection serves to engage behind a structure of the bottom, in particular of the receiving region, preferably in the manner of an undercut engagement, in order to fix the suspension element in the first position. For example, the projection can be provided and designed to be clicked into a corresponding structure of the bottom. The stability of the container is then ensured if the suspension element is fixed in the first position. At the same time, it is possible, by applying a force which is greater than or equal to the retaining force of the suspension element in the first position, to bring about a release of the suspension element such that it can then be transferred into the second position if the container is intended to be transferred into its use state. The structure is preferably provided by at least one lateral depression in the receiving region.

As has already been stated above, the suspension element is not rigidly fixed in the first position but movably fixed within the first position. The second free end of the suspension element is fixed so as to be movable from the top downward within the first position. This particularly allows the release of the suspension element from its first position to be facilitated since a manual intervention, for example by means of a fingertip and/or a fingernail, between the hanger and the bottom of the container is made possible or at least facilitated. In one embodiment, this movability of the suspension element is achieved or at least assisted by virtue of the fact that the hinge is arranged on a base which provides the transition to the bottom of the container. The base preferably has a ridge on a side situated opposite to the container bottom, on which ridge the hinge is positioned. As a result, the movability in the first position can be assisted. Alternatively, or in addition, the movability of the suspension element is also achieved in that a thickness of the second, free end of the suspension element is chosen to be less than the height of the receiving region for the hanger. The selected shapes and/or dimensions allow a play to be provided between the hanger and the receiving region in the first position of the hanger. In particular, the hanger can thus be very easily released from its first position and brought into it again.

A further embodiment is characterized in that an indentation or constriction is formed between the second free end of the suspension element and the hinge. The indentation provides a type of gripping region, for example for the index finger and the thumb, and can assist the suspension of the container. The constriction is preferably configured to be concave at least in certain portions. This inwardly directed curvature particularly allows ergonomic gripping of the hanger by the fingers.

The receiving region for the suspension element preferably has a height which decreases from an outer side toward the longitudinal axis of the container. On the one hand, it is thus possible to increase the length of the suspension element and thus to improve the ease of handling in the second position of the suspension element. On the other hand, the suspension element can still be stored securely in the receiving region in its first position without protruding laterally. Starting from the hinge, in particular the base, the receiving region is preferably formed by at least three portions, a first inner portion which transitions via a first inner bend into a second central portion. This in turn transitions via a second outer bend into a third outer portion. The first inner portion extends substantially transversely, preferably perpendicularly, to the container longitudinal axis. The second central portion forms a, preferably rectilinear, ramp. The outer third portion forms a shorter ramp of greater inclination here. The first bend and/or the second bend can be provided by an angular transition or by a rounded-off transition.

Still further structural measures can be undertaken in order to assist, in a supplementary or alternative manner, the manual engagement in the receiving region to release the hanger from its fixed, first position. For example, the receiving region can have toward the outer side of the container a bend, preferably the second bend, in particular in the direction of the opening of the container. As a result, the opening for engaging in or for engaging below the suspension element can be increased. Alternatively, and/or in addition, an upper edge of the receiving region can be configured to be concave at least in certain portions. As a result, easier access can be had to the hanger in order to transfer it from its first position into its second position.

In a further variant, the container is characterized in that a first and a second receiving region for the suspension element are formed in the bottom of the container. The suspension element is preferably movable from the first receiving region into the second and back again. This makes it possible, for example, to reduce or avoid one-sided wear of the hinge. In one configuration, the first and the second receiving region are arranged opposite one another and/or configured to be substantially identical.

A further embodiment of the container is characterized in that a foot region for standing up the bottle is formed in an outer region of the bottom, and/or in that a recess is formed in the bottom, preferably starting from the foot region, through which recess the receiving region for the hanger extends. The recess particularly assists ergonomic gripping and holding of the hanger by the fingers.

In a variant, the suspension element is provided in a region of its second end with an aperture, for example in the form of a round hole or of a slot, for receiving a suspension device. When the container is to be used in its use state, thus in an intended operation of the container, the suspension device can engage through the aperture. A universal use of the container with numerous different suspension devices is thus possible.

In order to achieve a particularly simple manufacture of the container, it consists in a variant of precisely a single material. Suitable materials are, for example, polypropylene (PP) or polyethylene (PE), such as, for example, a high-density polyethylene (HDPE). Other plastic materials, such as, for example, copolymers which have monomer units composed of propylene, ethylene, butylene, butadiene, styrene and/or isoprene, can likewise be used.

Whereas containers known from the prior art routinely have a multilayer structure, in a variant the present container is composed of a single material layer. This likewise facilitates the manufacture and the subsequent reuse of the container. However, it can also be of multilayer structure.

The container can be composed, for example, of a semi-transparent or a translucent material. It is possible in this way for the filling level of an enteral nutrient solution received in the container to be easily detected from the outside. The container can also be nontransparent in certain portions as a result of an applied label, an applied print and/or an applied coating.

The cross section of the container in the region of the bottom is preferably increased with respect to the central region of the container. On the one hand, it is thus possible for the stability to be improved if the container is intended to be set down on a table, for example. On the other hand, the container can thus be securely gripped if it is intended to be suspended upside down via its hanger.

In a further variant, the container has, at least in a portion which is situated approximately in the center of the container in the direction of longitudinal extent of the container, a cross section which has mutually adjoining convexly curved and rectilinear portions in an alternating arrangement. Here, in a variant, rectilinear portions and convexly curved portions are each situated precisely opposite to one another. In this way, the container can be gripped in a particularly simple and secure manner. Moreover, by virtue of the arrangement of such rectilinear portions, said container can be stored not only in a standing position but also in a lying position, namely using a rectilinear portion as a standing or lying surface. Even for the case that the container is stored in a lying position, it is extremely advantageous if the suspension element is fixed securely in its first position, since then the container has no unnecessarily outwardly projecting elements which would increase the space requirement when the container is stored in a lying position.

Edges (or corners in cross section) arise at the transitions between the convexly curved and the rectilinear portions of the side walls of the container, which means that the above-discussed cross section can also be referred to as a substantially polygonal cross section.

In a variant, the rectilinear portions have a width which, in a portion of the container which is situated closer to the opening than the central portion, is greater than in the central or center portion of the container. A still easier grippability of the container is achieved in this way, since then a user of the container is intuitively incited to grip the container in precisely those rectilinear portions of wider design. Since these are situated above the central portion of the container, gripping in such a case is carried out in a region which is situated considerably above the center of gravity of the container. There consequently results a self-stabilization of the container, whereby secure manual transport and secure handling of the container are ensured.

In a further variant, the container can have, at least in a portion which is directed closer toward the bottom than the central portion of the container, a cross section which has convexly curved portions and at least one concavely curved portion in an alternating arrangement. Here, the convexly curved portions and the concavely curved portion or the concavely curved portions are preferably arranged so as to directly follow one another.

For example, the above-explained rectilinear portions can be replaced in this region of the container by concavely curved portions. This results in a cross section of the container that corresponds to a stylized flower. The advantages of such a configuration come particularly to bear when the suspension element extends in its first position between two mutually opposite concavely curved portions or extends between a concavely curved portion which is situated opposite a rectilinear portion, as is provided in a variant, since then the concavely curved portions allow particularly simple access to the suspension element, with the result that it can be transferred easily from its first position into its second position and, if required, from its second position into its first position.

In a variant, there can be provided only a single concavely curved portion which is arranged between two convexly curved portions. For example, a cross-sectionally rectilinear portion can be arranged opposite this concavely curved portion. In this variant, there is provision in particular that the second end of the suspension element faces the concavely curved portion in the first position of the suspension element, whereas the hinge device is arranged at the first end of the suspension element on a rectilinear portion or on a convexly curved portion of the cross section of the container. In this variant, too, good accessibility of the second end of the suspension element is still afforded, with the result that it can be transferred in a simple manner from the first position into the second and from the second position into the first.

In a further variant, the container has, around the opening, a thread for receiving a cover. The cover can, for example, have a connection by means of which the container can be connected to a transfer system through which an enteral nutrition solution received in the container can be transported to a patient.

In a variant, the container, the suspension element, the hinge device and in particular the base are formed in one piece. This facilitates the manufacture of the container and ensures simple, but nevertheless reliable handling of the container or of the suspension element.

In a further variant, the side walls of the container are designed to be free of horizontally and/or vertically extending ribs. Such ribs can be used in containers for enteral feeding solutions in order to ensure better heat transfer if, for example, the feeding solution is intended to be brought to a certain temperature. However, such ribs require increased material use and moreover a more complex mode of manufacture of the container. In addition, residues of the nutrient solution received in the container frequently remain in such ribs, with the result that simple removal of the residues from the container is made more difficult by such ribs. For cost and efficiency reasons, it is therefore advantageous to dispense with such ribs.

In the bottom there is formed a receiving region for the suspension element in which the suspension element can be received in its first position. Here, the suspension element is received in such a way that the suspension element does not project beyond other regions of the bottom. For example, it can be arranged flush with respect to other regions of the bottom. In particular, a height difference between the receiving region on the outer side of the container and the remaining regions of the bottom in the direction of longitudinal extent of the container is at most 15 mm. The height difference in the direction of longitudinal extent of the container between the receiving region and the remaining regions of the bottom can lie in a range from 0.5 to 15 mm, for example.

In a variant, the container has a volume which is greater than 150 ml, in particular greater than 300 ml, in particular greater than 400 ml, in particular greater than 500 ml, in particular greater than 600 ml and very particularly greater than 750 ml. A suitable volume lies, for example, in the range from 300 ml to 500 ml, with other ranges which are formed from the aforementioned upper limits likewise being conceivable and provided.

The container can be produced by means of extrusion blow molding, for example. In an alternative variant, production by means of stretch blow molding is provided.

Further details and particulars of the present invention will be explained with reference to an exemplary embodiment and corresponding figures, in which.

Figure 1A:
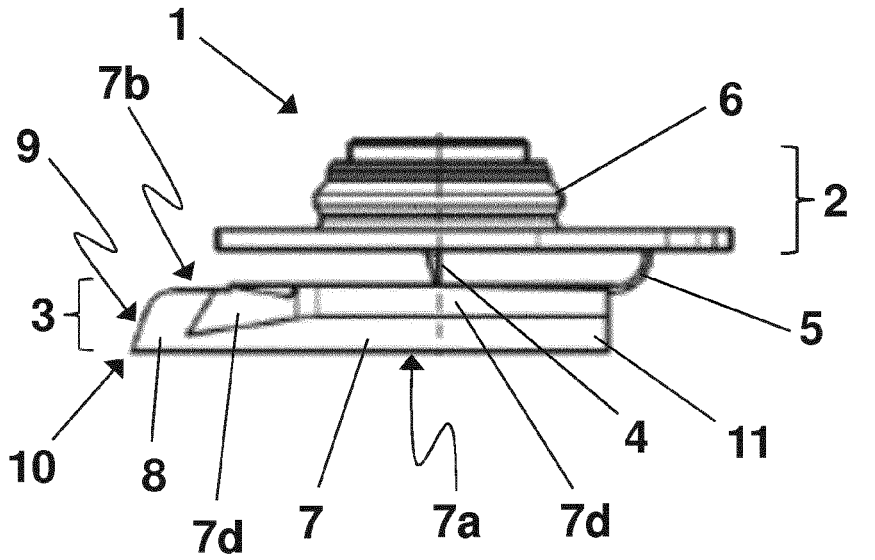
FIG. 1A shows a side view of an exemplary embodiment of an opening device.

FIG. 1A shows an opening clip 1 which serves as an opening device. This opening clip 1 has an upper part 2 which serves as a first part, and a lower part 3 which serves as a second part. The upper part 2 is connected to the lower part 3 via at least one retaining element 4, which serves as a fixing element, and via at least one hinge 5. The upper part 2 is preferably connected to the lower part 3 via two retaining elements 4 (see in this respect FIG. 2C) and via a hinge 5. The upper part 2 has on its upper side a projecting, preferably round structure 6 which is provided and designed to be inserted into an inner region of a connection piece of a cover. The lower part 3 has, in particular on its underside, a cutting knife-like blade 7. The blade 7 is designed to be pointed on its front region 8, with the result that a blade tip 10 is provided. For this purpose, the underside 7*a* of the blade 7 forms an acute angle 10 with a lateral surface 9 arranged in the front region 8. For example, the acute angle 10 lies in a range from greater than 45° to less than 90°, preferably from 50° to 85°, particularly preferably from 60° to 75°. Here, the lateral surface 9 of the lower part 3 that is arranged in the front region 8 is arranged oppositely to a rear side 11 in the direction of longitudinal extent of the lower part 3, the hinge 5 being mounted on the lower part 3 on the rear side 11. The length of the lower part 3 along the longitudinal axis of the blade 7 lies, for example, in a range from 10 mm to 50 mm, preferably from 20 mm to 30 mm.

Figure 1B:
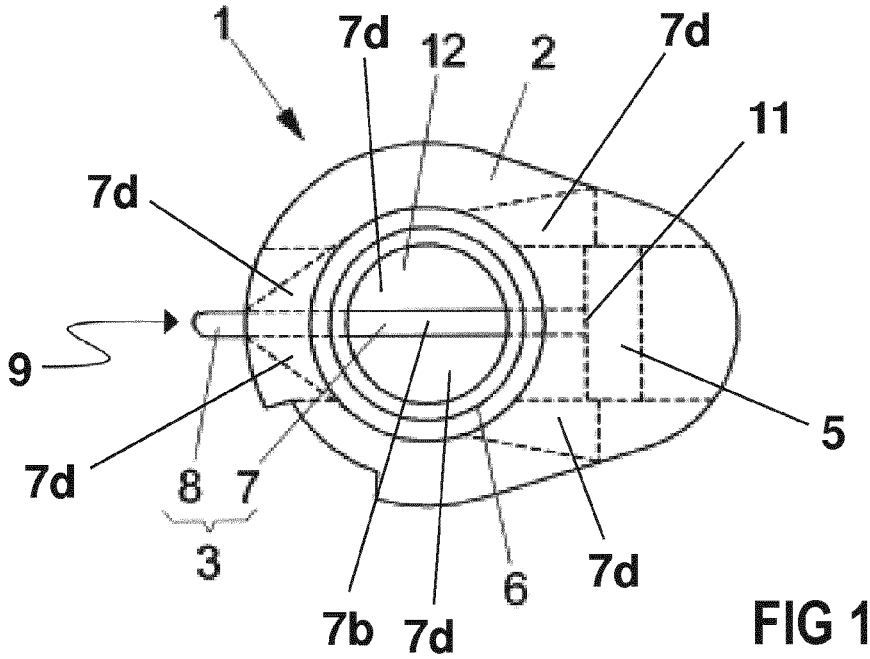
FIG. 1B shows a plan view of the opening device of FIG. 1A.

FIG. 1B shows a plan view of the opening clip from FIG. 1A, with the same reference signs as in FIG. 1A being used for the individual elements, and so reference is made to the statements given for said figure. Moreover, FIG. 1B reveals an opening 12 which is formed in an inner region of the preferably round structure 6. Through this opening there can be guided an attachment piece 22 of a hose line 21 through the structure 6 and thus through the upper part 2 of the opening device 1 in order to butt against the blade 7 of the lower part 3.

Furthermore, FIG. 1B reveals the upper side 7*b* of the blade 7. This can also be referred to as the blade spine 7*b*. The upper side 7*b* has a greater thickness than the underside 7*a* of the blade 7 that is used for cutting open, which underside is also referred to as the cutting edge 7*a*. The blade 7 preferably has a substantially triangular cross section (see in this respect FIG. 2C) at least in certain portions. The two legs 7*c* of the blade 7 enclose, for example, an angle of 20° to 60°, preferably of 30° to 50°. In addition, two wings 7*d* are arranged laterally on the blade 7. Since a plan view of the opening device 1 is illustrated here and the two wings 7*d* are situated as a constituent part of the lower part 3 below the upper part 2, the wing edges are illustrated by dashed lines. The wings 7*d* extend laterally starting from the upper side 7*b* of the blade 7 (see in this respect FIG. 2C). The wings 7*d* are positioned here so as to be offset rearwardly from the tip 8 of the blade 7. They have a width which increases in the direction of the rear side 11. For example, the wings 7*d* have a substantially triangular configuration here. Moreover, a bend can be present in the legs of the triangle. For illustrative purposes: the lower part 3 or the blade 7 with the wings 7*d* has a similarity to the configuration of a Concorde-type jet aircraft.

The wings 7*d* have, for example, a maximum width of 5 mm to 30 mm, preferably of 10 mm to 20 mm, in the direction of the rear part 11. The wings 7*d* have a greater width than the hinge 5 in the direction of the rear part 11. The hinge 5 has a width of 5 mm to 12 mm, for example. The thickness of the wings 7*d* is such that they are substantially not flexible, and is between 0.5 mm and 3 mm, for example. The wings 7*d* serve here as displacers for a covering 20, for example for an aluminum foil 20, which closes a bottle 13 (see in this respect the following description).

Figure 2A:
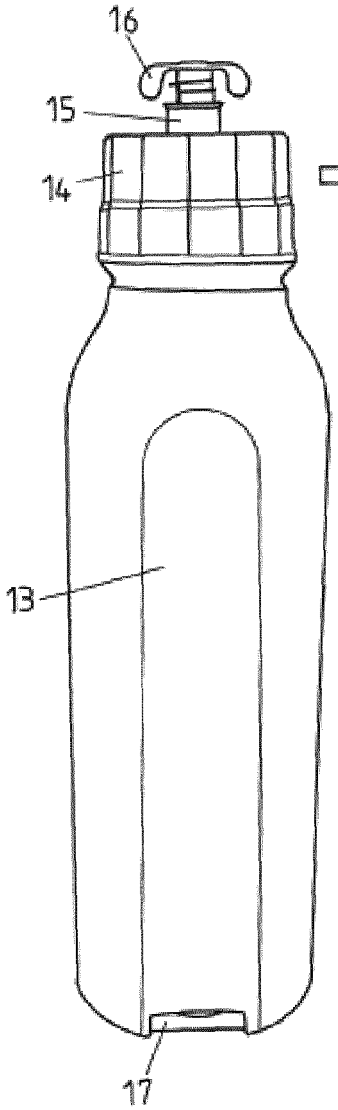
FIG. 2A shows a side view of a bottle which is closed with a cover and which is filled with an enteral nutrition solution.

FIG. 2A shows a bottle 13 which is filled with an enteral nutrition solution and which serves as a container for an enteral nutrition solution. This bottle 13 is provided on its upper side with a cover 14 which has a connection piece 15 which is closed with a cap 16. On the underside of the bottle 13 there is arranged a hanger 17 which, in a swung-in state, is situated in a receptacle provided therefor.

Figure 2B:
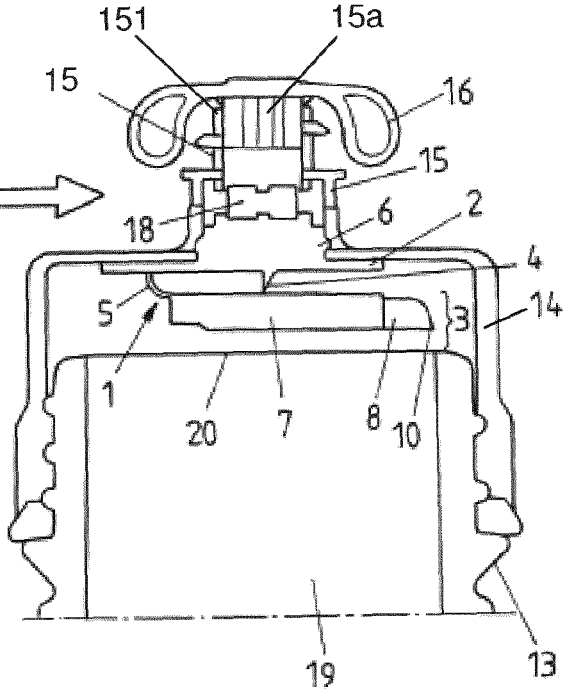
FIG. 2B shows a sectional view through the cover region of the bottle from FIG. 2A.
Figure 2C:
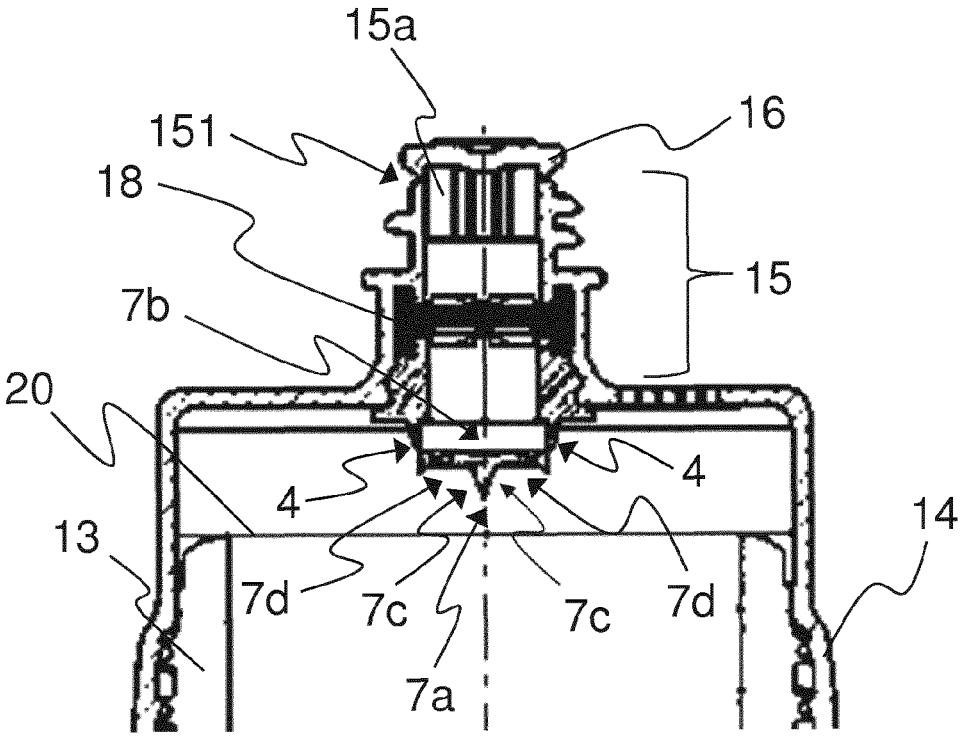
FIG. 2C shows a sectional view (perpendicular to the sectional view in FIG. 2B) through the cover region of the bottle from FIG. 2A.

FIG. 2B shows a sectional illustration through the region of the cover 14 of the bottle 13 from FIG. 2A. The opening clip 1, which has been explained in detail in FIGS. 1A and 1B, is inserted in the inner region of the cover 14. Here, the annular structure 6 of the upper part 2 of the opening clip 1 is clipped in an inner region of the connection piece 15. A form- and/or force-fitting connection is obtained. The opening device 1 can be connected or is connected, preferably permanently, to the cover 14 via its structure 6 by means of a snap connection. FIG. 2C shows a sectional view perpendicular to the sectional view in FIG. 2B.

For sealing purposes, a membrane 18, preferably a cross-port stopper 18, is provided between the opening clip 1 and an outer region 151 of the connection piece 15. The membrane 18 is preferably a reclosable membrane. The design of the membrane 18 as a cross-port stopper assists the selection device 15*a*. The actual selection device 15*a* is provided by the shape of the connection piece 15. In detail, the selection device 15*a* is arranged in an upper region of the connection piece 15. The selection device 15*a* is preferably provided by the opening in the upper side 151 of the connection piece 15. Here, by way of example, the opening has a cruciform geometry. It is thus possible in general for only an attachment piece 22 adapted to the geometry of the selection device 15*a* to be introduced into the connection piece 15. In this case, this cruciform opening ensures that in general only cruciform spikes 22 as attachment pieces of a hose line can be guided through the connection piece 15. By contrast, spikes used in particular in the field of infusion therapy cannot be guided through. It is thereby possible, for example, to avoid the intravenous administration of an enteral solution.

In FIGS. 2B and 2C, the opening clip 1 is situated in its starting state in which the lower part 3 extends here for example substantially parallel to the upper part 2 of the opening clip 1. An inner region 19 of the bottle 13 that is filled with the enteral nutrient solution is closed at its end facing the cover 14 with a foil 20, for example an aluminum foil 20, as a covering.

Furthermore, it can be seen that the upper part 2 is connected to the lower part 3 via two retaining elements 4. In the initial state, the retaining elements 4 are preferably in one piece with the opening device 1. Here, the retaining elements 4 have a cross section which tapers from the upper part 2 to the lower part 3. They are connected to the lower part 3 via a point connection as it were. Here, the retaining elements 4 are each configured as a kind of barb.

Figure 2D:
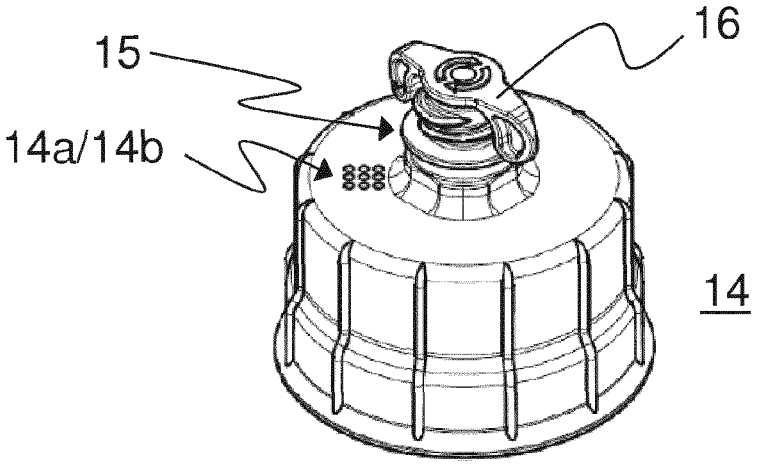
FIG. 2D shows a perspective plan view of the cover (without connected bottle)

In addition, FIGS. 2C and 2D reveal the openings 14*a* via which the bottle 13 is ventilated during liquid removal. In order to prevent or at least reduce contamination of the liquid, a filter 14*b* which closes the openings 14*a*, for example a Porex filter, is provided. In order that the openings are not concealed, a cutout is provided in the upper part 2 of the opening device 1 (see in this respect FIG. 1B, bottom).

Figure 3A:
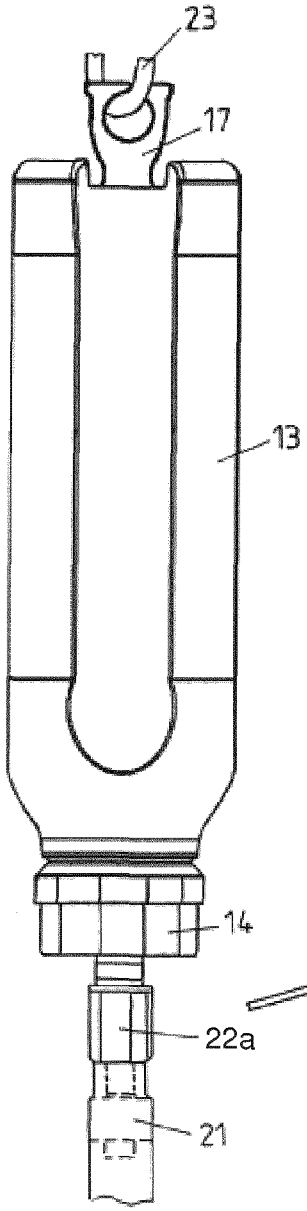
FIG. 3A shows a side view of the bottle from FIG. 2A after it has been connected to a hose line.

FIG. 3A now shows the bottle 13 from FIG. 2A in a state in which the enteral nutrient solution contained in the bottle 13 can flow out of the bottle 13. For this purpose, a spike 22, for example of a hose line 21, is guided through the connection piece 15 of the cover 14. The hose line 21 is connected to the connection piece via a screw cap 22*a*, for example. In order for this to be possible, the cap 16 illustrated in FIGS. 2A and 2B has been removed beforehand by being broken out or off, for example twisted off.

Figure 3B:
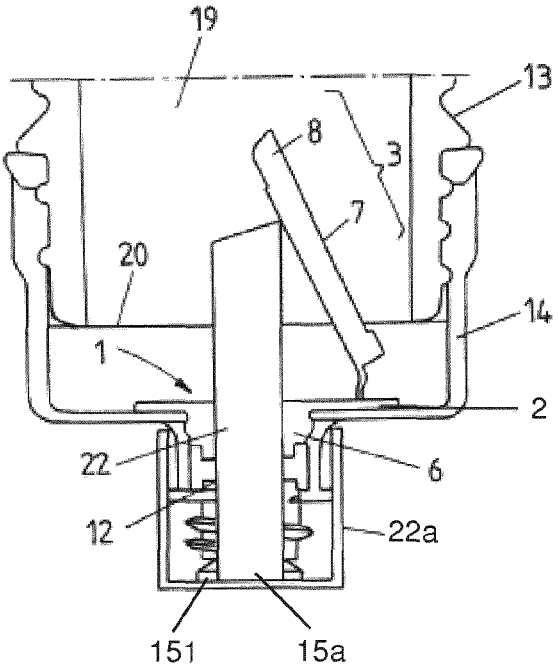
FIG. 3B shows a sectional view through the cover region of the bottle shown in FIG. 3A.

FIG. 3B now shows how the spike 22 as an attachment piece of the hose line 21 is introduced through the connection piece 15 into the interior 19 of the bottle 13. It can be clearly seen here that the spike 22 extends through the opening 12 in the annular structure 6 of the upper part 2 of the opening clip 1 and has released the retaining elements 4 between the lower part 3 and the upper 2 of the opening clip 1 by tearing. Furthermore, the spike 22 has pressed the lower part 3 of the opening clip 1 into the interior 19 of the bottle 13. Here, the cutting knife-like blade 7 of the lower part 3 has cleanly cut open the aluminum foil 20 such that the spike 22 was subsequently able to penetrate through the cut-open opening into the interior 19 of the bottle 13.

Upon pressing down the lower part 3, the aluminum foil 20 of the bottle 13 is first pierced by the tip 10 of the blade 7 and thus opened. Upon further pressing down of the lower part 3, starting from the opening point produced by the blade tip 10, the underside 7*a* of the blade 7 cuts open the aluminum foil 20 further. After and/or during further cutting open, the aluminum foil 20 is displaced by the widening wings 7*d* of the blade 7 or of the lower part 3. As a result, the gap opening produced by the blade 7 is increased in order to obtain a larger opening for a sufficient throughflow.

A tearing-open of the aluminum foil by the spike 22 and a release of individual parts of the aluminum foil 20 have been reliably avoided by the cutting open of the aluminum foil 20 by means of the blade 7 of the opening clip 1. Moreover, the enteral nutrition solution can now flow out of the interior 19 of the bottle 13 through the spike 12 into the hose line 21. In order that such a flow of the nutrient solution is possible in a particularly simple manner, the bottle 13—as shown in FIG. 3A—is suspended on a hook 23 by the hanger 17. The enteral nutrient solution can then flow out of the bottle 13 by means of gravitational force. Here, the outflow behavior is particularly advantageous by virtue of the cleanly cut-open aluminum foil 20 and the large opening produced.

LIST OF REFERENCE SIGNS

| | |
|---|---|
| 1 | Opening device or opening clip |
| 2 | Upper part of the opening clip |
| 3 | Lower part of the opening clip |
| 4 | Retaining element or fixing element |
| 5 | Hinge |
| 6 | Round structure |
| 7 | Blade |
| 7a | Underside of the blade or cutting edge |
| 7b | Upper side of the blade or blade spine |
| 7c | Leg of the blade |
| 7d | Wing on the blade |
| 8 | Front region of the lower part or of the blade |
| 9 | Lateral surface of the lower part or of the blade |
| 10 | Blade tip or acute angle |
| 11 | Rear side of the lower part |
| 12 | Opening |
| 13 | Bottle |
| 14 | Cover |
| 14a | Opening or ventilation opening in the cover |
| 14b | Filter in or on the ventilation opening in the cover |
| 15 | Connection piece |
| 15a | Selection device |
| 151 | Outer region or upper side of the connection piece |
| 16 | Cap or break-off cap |
| 17 | Hanger |
| 18 | Seal or membrane or cross-port stopper |
| 19 | Interior of the bottle |
| 20 | Covering or foil or aluminum foil |
| 21 | Hose line |
| 22 | Spike |

-continued

| | |
|---|---|
| 22a | Screw cap |
| 23 | Hook |

The invention claimed is:

1. An apparatus comprising a cover for a container for receiving enteral nutrition solutions and an opening device that is arranged on an inner side of the cover to cut into a covering disposed at an opening of the container, wherein the cover includes a connecting device for connection to a connection partner on the container and a connection piece for connection to a hose line, wherein the opening device comprises first and second parts, the first part being connected to the cover and the second part being connected to the first part, wherein the second part comprises a first end region, a second end region, a displacer, and a cutting knife, wherein the cutting knife comprises a blade having a tip and a cutting edge, the tip being at the second end region and the cutting edge extending away from the tip along a line between the second end region and the first end region, wherein the displacer comprises a wing that extends laterally outward from the blade along a plane that is perpendicular to the line and that widens in a direction of the first end region, wherein the wing's width at the first end region is greater than the wing's width at the second end region, wherein, in operation, the tip punctures the covering, the cutting edge forms a cut in the covering, and the wing pushes the covering laterally, thereby increasing the size of the opening formed by the cutting edge, wherein the opening device transitions between a starting state and an opening state, and wherein, in the opening state, the second part is movable relative to the first part.

2. The apparatus of claim 1, further comprising a fixing element and a hinge, wherein, in the starting state, the fixing element fixes the first and second parts together, and wherein the hinge connects the first part and the second part independently of the fixing element.

3. The apparatus of claim 2, wherein the hinge element acts on the first end region.

4. The apparatus of claim 1, wherein the second end region is situated opposite the first end region in a direction of longitudinal extent of the opening device, wherein a hinge is disposed on the second end region, moving the second part around a hinge axis causes the first end region to cover a distance on a circular arc that is greater than the distance covered by any other portion of the second part.

5. The apparatus of claim 4, wherein, in order to provide the blade tip, an underside of the blade and a lateral surface of the blade that is formed in the second end region of the second part of the opening device that is situated opposite to the first end region in the direction of longitudinal extent of the opening device are arranged at an acute angle to one another.

6. The apparatus of claim 1, wherein the wing is positioned on the blade so as to be offset away from the blade tip in the direction of the first end region.

7. The apparatus of claim 1, further comprising a fixing element that connects the first and second parts together in the starting position, wherein a retaining force that retains the first part in the cover is greater than a force that is required to release the connection, which is brought about via the fixing element, between the first and second parts and wherein the fixing element has a cross section that tapers starting from the first part in the direction of the second part.

8. The apparatus of claim 1, wherein, in the starting state, the second part of the opening device extends substantially parallel to the first part of the opening device, wherein, in the opening state, the second part of the opening device extends transversely to the first part of the opening device, and wherein the first part of the opening device has a through-opening in a central region through which an attachment piece of a hose line can be guided in order to contact the second part of the opening device.

9. The apparatus of claim 1, wherein the connection piece has a selection device with a cruciform geometry in order that an attachment piece adapted to a geometry of the selection device can be introduced into the connection piece and wherein the selection device is arranged in an upper region of the connection piece, with an upper side of the connection piece being provided by the selection device.

10. The apparatus of claim 1, further comprising a break-off cap for closing the connection piece.

11. The apparatus of claim 1, further comprising a seal that comprises a slot, wherein the seal is arranged between the connection piece and the opening device, and wherein the slot is adapted to the geometry of a selection device.

12. The apparatus of claim 1, wherein the first part connects to the cover in a force-fitting manner.

13. The apparatus of claim 1, further comprising the container, wherein the container has an opening via which an enteral nutrition solution can be fed into the container or out of the container, wherein the covering comprises a foil and the connecting device for receiving a cover is arranged around the opening, and wherein the connecting device of the cover and the connection partner of the container are connected to one another in such a way that the cover covers the opening and closes it in a liquid-tight manner.

14. The apparatus of claim 1, wherein the wing extends laterally from an upper side of the blade.

15. The apparatus of claim 1, wherein the second part is connected permanently to the first part.

16. The apparatus of claim 1, further comprising a fixing element, wherein, in the starting state, the fixing element fixes the first and second parts together.

17. The apparatus of claim 1, wherein the wing is a first wing, wherein the displacer further comprises a second wing that extends laterally in a direction opposite the first wing.

18. The apparatus of claim 1, wherein the wing is a first wing, wherein the displacer further comprises a second wing, wherein the first and second wings are configured in the manner of wings of a Concorde-type jet aircraft.

19. The apparatus of claim 1, wherein the wing is triangular in shape.

20. The apparatus of claim 1, wherein the first part is directly connected to the second part.

21. The apparatus of claim 1, further comprising a twist-off cap for closing the connection piece.

22. The apparatus of claim 1, further comprising a filter, wherein the cover comprises a ventilation opening, and wherein the filter closes the ventilation opening.

23. The apparatus of claim 1, wherein the blade comprises a spine and wherein the wing extends from the spine.

24. The apparatus of claim 1, wherein the first part connects to the cover in form-fitting manner.

* * * * *